US008857497B1

(12) United States Patent
Konrad et al.

(10) Patent No.: US 8,857,497 B1
(45) Date of Patent: Oct. 14, 2014

(54) ROLLING SHUTTER SYSTEM WITH A PLURALITY OF SINGLE WALL SLATS

(71) Applicant: Rollac Shutter of Texas, Inc., Pearland, TX (US)

(72) Inventors: Walter M. Konrad, Pearland, TX (US); Stefan A. Poetsch, Houston, TX (US); Eva L. Konrad, Houston, TX (US)

(73) Assignee: Rollac Shutter of Texas, Inc., Pearland, TX (US)

( * ) Notice: Subject to any disclaimer, the term of this patent is extended or adjusted under 35 U.S.C. 154(b) by 0 days.

(21) Appl. No.: 13/968,608

(22) Filed: Aug. 16, 2013

Related U.S. Application Data

(63) Continuation-in-part of application No. 12/710,229, filed on Feb. 22, 2010, now Pat. No. 8,584,731.

(60) Provisional application No. 61/166,083, filed on Apr. 2, 2009.

(51) Int. Cl.
*E06B 3/06* (2006.01)
*E06B 9/15* (2006.01)

(52) U.S. Cl.
CPC ..... *E06B 9/15* (2013.01)
USPC ..... 160/235; 160/233; 160/183

(58) Field of Classification Search
CPC ..... E06B 9/08; E06B 9/11; E06B 9/15; E06B 9/17; E06B 3/06
USPC ..... 160/233–236, 229.1, 183
See application file for complete search history.

(56) References Cited

U.S. PATENT DOCUMENTS

| | | | | |
|---|---|---|---|---|
| 3,012,318 | A | 12/1961 | Nelson | |
| 4,723,588 | A | 2/1988 | Ruppel | |
| 5,204,147 | A | 4/1993 | Schneider | |
| 5,343,922 | A | 9/1994 | Rankl et al. | |
| 5,365,990 | A | 11/1994 | Ueda | |
| 5,419,386 | A | 5/1995 | Magro et al. | |
| 5,474,118 | A * | 12/1995 | Hoffman | 160/235 |
| 5,515,902 | A * | 5/1996 | Hoffman | 160/235 |
| 5,601,130 | A | 2/1997 | Werner et al. | |
| 5,611,383 | A | 3/1997 | Hoffman | |
| 5,613,539 | A | 3/1997 | Kraler | |
| 5,740,850 | A * | 4/1998 | Hoffman | 160/183 |

(Continued)

OTHER PUBLICATIONS

Heroal—Johann Henkenjohann GmbH & Co.KG, Rollgitter S, "Artikelliste", Feb. 1, 2002, Verl, Germany.

(Continued)

*Primary Examiner* — Katherine Mitchell
*Assistant Examiner* — Abe Massad
(74) *Attorney, Agent, or Firm* — Buskop Law Group, PC; Wendy Buskop

(57) ABSTRACT

A rolling shutter assembly for covering an opening of a facility. A rolling shutter housing is mounted to the facility and connects with first and second shutter rails. A rolling shutter cover forms part of the rolling shutter housing and contains a rotating axle with a drive mechanism or gear assembly engaging the rotating axle positioned between side caps that close the sides of the rolling shutter cover. A plurality of single wall shutter slats are contained in a rolled up configuration within the rolling shutter housing and deployable to form a protective curtain, with a first single wall shutter slat connected to the rotating axle and additional single wall shutter slats connected in series to the first shutter slat.

19 Claims, 9 Drawing Sheets

(56) References Cited

U.S. PATENT DOCUMENTS

| | | | | |
|---|---|---|---|---|
| 5,839,493 | A | 11/1998 | Quasius | |
| 5,850,862 | A * | 12/1998 | Miller | 160/133 |
| 5,957,186 | A * | 9/1999 | Boswell | 160/201 |
| 6,095,225 | A * | 8/2000 | Miller | 160/133 |
| 6,345,476 | B1 | 2/2002 | Hill | |
| 7,100,665 | B2 | 9/2006 | Miller | |
| 7,357,171 | B2 | 4/2008 | Miller | |
| 7,784,522 | B2 | 8/2010 | Miller | |
| 8,109,316 | B2 | 2/2012 | Wang | |
| 8,162,025 | B2 | 4/2012 | Motosko et al. | |
| 8,584,731 | B1 * | 11/2013 | Konrad et al. | 160/235 |
| 2003/0024659 | A1 | 2/2003 | Begni | |
| 2004/0003903 | A1 | 1/2004 | Wenrick et al. | |
| 2004/0188037 | A1 | 9/2004 | Schlater et al. | |
| 2005/0045280 | A1 | 3/2005 | Schlater et al. | |
| 2005/0205221 | A1 | 9/2005 | Miller | |
| 2005/0205222 | A1 | 9/2005 | Miller | |
| 2005/0205223 | A1 | 9/2005 | Miller | |
| 2007/0137802 | A1 | 6/2007 | Lukasik et al. | |
| 2007/0221341 | A1 | 9/2007 | Schanz | |
| 2008/0202700 | A1 | 8/2008 | Miller | |
| 2009/0178769 | A1 * | 7/2009 | Miller | 160/133 |
| 2011/0162807 | A1 | 7/2011 | Miller | |

OTHER PUBLICATIONS

Heroal—Johann Henkenjohann GmbH & Co.KG, Single Wall Slats, "Rolladenpreisliste", Jan. 1987, Verl, Germany.

* cited by examiner

FIGURE 1
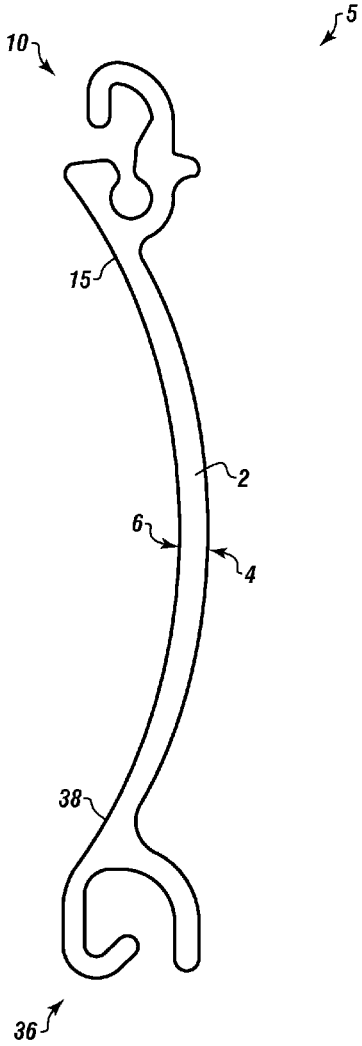
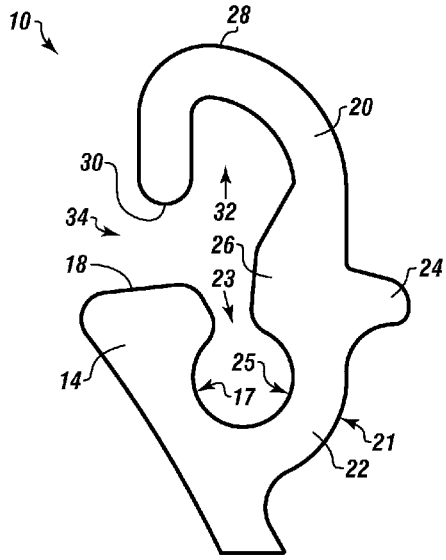
FIGURE 2
FIGURE 3
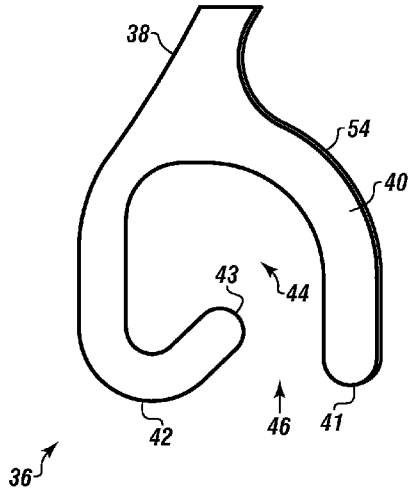

ROLLING SHUTTER SYSTEM WITH A PLURALITY OF SINGLE WALL SLATS

CROSS REFERENCE TO RELATED APPLICATIONS

The present application is a Continuation in Part of co-pending U.S. patent application Ser. No. 12/710,229 filed on Feb. 22, 2010, entitled "SHUTTER SLAT FOR A ROLLING SHUTTER SYSTEM," which claims priority to and the benefit of U.S. Provisional Patent Application Ser. No. 61/166,083 filed on Apr. 2, 2009, entitled "Shutter Slat for a Rolling Shutter System. These references are hereby incorporated in their entirety.

FIELD

The present embodiments generally relate to a rolling shutter assembly using a single wall shutter slat.

BACKGROUND

A need exists for a lightweight, easy to install rolling shutter assembly with single wall shutter slats that is flexible and is quickly installed in the field in the event of strong winds, such as during a storm or hurricane.

Furthermore, there is a need for business owners especially retail store locations to protect their premises while still having the ability to present their merchandise or providing an insight view for authorities such as police or firefighters. The rolling shutter assembly meets this need with a quick deploying, lightweight system that is easy to deploy.

The present embodiments meet these needs.

BRIEF DESCRIPTION OF THE DRAWINGS

The detailed description will be better understood in conjunction with the accompanying drawings as follows:

FIG. 1 is a side view of a single wall shutter slat.

FIG. 2 is a detailed view of a top hook portion.

FIG. 3 is a detailed view of a bottom hook portion.

Figure 4:
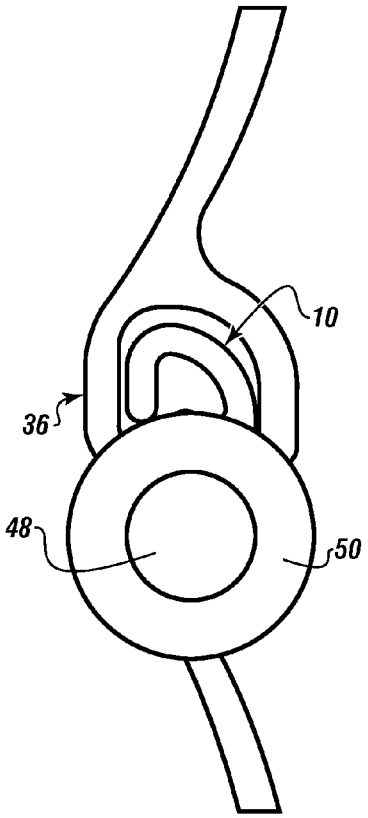
FIG. 4 is a side view of two interconnected single wall shutter slats.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a rolling shutter assembly using a single wall shutter slat.

The present embodiments further relate to a rolling shutter assembly for covering an opening, or a door, or a window of a facility.

The rolling shutter assembly has a first shutter rail and a second shutter rail mounted in parallel to the facility, wherein the facility can be a house, an office building, a warehouse or similar structure needing protection from severe weather, such as hurricanes, and security protection from thieves, intruders, or the like.

The term "opening" can refer to an actual opening that is a hole in a facility, a closable door of a facility, a closable window of a facility, and other frangible objects, including artwork. The term opening has the broad interpretation to also be used to include cases including display cases, gun cases and trophy cases.

The rolling shutter housing can include a rolling shutter cover, a first side cap and second side cap mounted on opposite ends of the rolling shutter cover; a drive mechanism attached to one of the side caps. The drive mechanism can connect to a portable power supply, like batteries, a solar panel and batteries or to a secondary power supply, like a generator or to the electric grid. The drive mechanism can be a rod, strap, or spring to be operated manually.

A rotating axle can be attached to the drive mechanism. An idler which can be on the opposite end of the axle from the drive mechanism and connected to the side cap opposite the side cap connected to the drive mechanism. The rotating axle can be rotated by the drive mechanism. The drive mechanism can be a motor, a gear drive, or a motor and gear drive, a pulley, a spring, or another driving mechanism.

The first single wall shutter slat can be attached to the rotating axle via a connecting mechanism or a fastener. An additional shutter slat can connect to the first shutter slat, and other shutter slats can then connect in series forming a protection wall.

A plurality of single wall shutter slats can be fully contained in the rolling shutter housing in a rolled up configuration. The rolling shutter housing can contain from 2 single wall shutter slats to 150 single wall shutter slats.

Each single wall shutter slat can be a one piece integral construction with a top hook portion and a bottom receptacle portion that pivotally interlock with each other.

The signal wall shutter slat can have a slat body with a curved front side and a curved back side. The shutter slat can be a one piece integral item.

The shutter slat can have, on one end, which is a first end of the body, a top hook portion which can be constructed from a portion of the curved back side.

The top hook portion can have a fork shape with a ledge section and a hook section.

The ledge section can be formed from a portion of the curved back side. The ledge section can also have a first curved inner wall.

The ledge section can be a one piece unit integral with the slat body. The slat body can have a shape, such as a triangle, a square, a rectangular, a polygon, and combinations thereof.

The top hook portion has a hook section with an inner side and an outer side. The hook section has a curved wall with the ledge section and the two portions of hook shape and ledge section, that is the Y-shape or forked shape with the ledge section can create a central cavity.

An extending lip can be formed on the outer side of the hook section and can extend away from the curved wall.

Opposite the extending lip, a reinforced section, which can have a thickness greater than the extending lip extend at least 10 percent of the length of the slat body. The thicker reinforced section can be disposed between the curved wall and a top hook of the top hook portion.

The top hook can have an end, which can be curved. The hook end of the top hook can be opposite the ledge and a first opening is formed between the ledge and the hook end.

The curved portion of the top hook forms a second cavity. The second cavity is generally opposite the central cavity but the two cavities are not aligned.

The second cavity enables the unique interlocking feature between the single wall shutter slats, enabling the slats to interconnect pivotally together.

Formed as part of the slat body opposite the first end can be a second end, and a bottom receptacle portion.

The second end can be formed from a portion of the curved back side.

The bottom receptacle portion can have a counter wall with a counter wall end formed opposite a bottom hook with a bottom hook end.

The inner portions of the bottom receptacle portion and the bottom hook can form a bottom cavity. Additionally the bottom hook end can end before connecting to the outer wall end forming a bottom opening between the counter wall and the bottom hook.

The top hook of a first slat body is adapted to slide into the bottom opening along the entire length of a second similarly formed the slat body.

This sliding construction allows the integral engagement of two slat bodies and can allow the two slats to pivotably engage between the bottom hook and the counter wall, which further allows the counter wall end to rest on the extending lip, and the bottom hook end can rest on the ledge, which in embodiments can extend the entire width (from rail to rail) of the slat body.

An alignment device can be used in an end of the slat body to engage the central cavity and align a first shutter slat with a second shutter slat using the central cavity.

In one or more embodiments, the alignment device can have a fastener portion connected to a fastener head.

The alignment device can have an alignment head for receiving a tool to tighten down the alignment device, or for receiving a tool that allows a slidable insertion of the alignment tool into the central cavity.

The alignment device in embodiments can have a length from about 1 centimeter to about 7 centimeters and a body portion that slides within the cavity. In embodiments, the head portion does not have to slide within the cavity.

Embodiments provide a small roll diameter for the slats. In general, the smaller the overall width of one of the single wall shutter slats, the smaller the roll diameter it forms when rolled up into the rolling shutter housing.

A small roll diameter single wall shutter slat can convert into a more accurate opening/housing size ratio. Compared to other rolling shutter slats, which are typically double wall, this slat can have a small overall width and thus a better opening/housing size ratio. That is, this invention makes for a smaller assembly with the same strength as a double wall slat assembly but lighter for shipping and cheaper to make, as less material is needed to form the slat bodies.

Additionally the present embodiments can provide the benefit of easy perforation for the slats in case the owner of the facility desires to have an entire curtain, with one or more slats having openings for allowing light in or see through capability while the slats are deployed forming a wall.

The embodiments relate to a single walled slat body usable in the rolling shutter assembly. A single walled slat is perforated easier than double walled slats.

In the rolling shutter assembly, perforated slats can allow visibility through the assembled wall/curtain, when the single wall shutter slats inter-engage through the cavities forming a curtain of inter-engaged, pivotable single walled slats, with one slat body sitting on ledges and lips of another single wall shutter slat body, rather than hanging, as is known in the industry.

The top hook portion of the slat body provides a benefit in that the top hook portion is a curved wall with a ledge section, both of which can surround the central cavity.

This configuration strengthens the entire top hook portion, as more material can then be allocated and provide reinforcement of the hook. Furthermore, the extra reinforcement section with the top hook portion can provide additional stability for the top hook portion.

A strong top hook portion as provided with these single wall shutter slats prevents the profile from breaking when exposed to strong forces, such as forceful impact from pebbles or other particulate matter or wind velocity pressure of hurricane strength.

Another benefit of the inventive rolling shutter housings is that the single wall shutter slat body provides a curved design.

The entire slat body design is curved and sharp edges are then avoided. An additional benefit of this design is that it can allow certain colors to be applied more easily to the front side.

An advantage of the curved design is that it can simultaneously prevent injury, and can allow a distribution of force downward, as one single wall shutter slat sits on another slat rather than hanging. This design prohibits particulate matter from getting through the deployed single wall shutter slats when they form the protective wall.

An embodiment of the invention provides the benefit that the protective curtain formed from the unwound, deployed inter-engaged slats has a high degree of engaged stability.

The design of the entire slat body, as a curved one piece structure with the counter wall end, can allow the counter wall end to stand on the lip and allow the bottom hook end to stand on the ledge for a dual reinforced stability, on two points of contact rather than just one.

The dual contacting support renders twice the level of stability, compared to hanging shutter systems, and prevents the slats from flapping and coming loose in high winds, such as during hurricanes, namely Force 5 winds.

The dual support construction allows the deployed slat curtain to entirely close when multiple individual slats are engaged and provide improved stability, as each slat body stands on each other. Instead of just being loosely engaged, the dual support configuration can provide more stability to the entire curtain.

Turning to the Figures, FIG. 1 shows a side view of a single wall shutter slat 5. The single wall shutter slat 5 has a slat body 2. The slat body can have an overall length from about 24 centimeters to about 8 meters and an overall height from about 40 millimeters to about 120 millimeters.

Each slat body can be a single wall construction and not doubled walled.

The shutter slat can have a thickness from about 1 millimeter to about 10 millimeters.

In embodiments, the shutter slat can be made of aluminum, steel, another alloy, a non-deforming composite, another non-deforming polymer, or combinations thereof.

It embodiments, the shutter slat can be encapsulated with a coating. The coating can be paint, a metal, a urethane, a polymer or combinations thereof.

The slat body 2 is curved between a top hook portion 10 on a first end 15 and a bottom receptacle portion 36 on a second end 38. The slat body can have a curved front side 4, which can present a smooth front surface and a curved back side 6. The curve of the slat body is similar to the top arc of a sinusoidal curve, with a curve arc from about 10 degrees to about 170 degrees.

FIG. 2 shows a detail of the top hook portion 10. The top hook portion can range in length from about 5 millimeters to about 30 millimeters and in width from about 5 millimeters to about 30 millimeters. The top hook portion 10 can have two sections, a hook section 20 and a ledge section 14.

The hook section 20 can extend from the slat body 2 with a curved wall 22 that can engage the curved front side 4 of the slat body 2. The curved wall 22 can have an inner side 25 that can form a portion of the central cavity 23, and an outer side 21 that can also be curved. The diameter of the central cavity 23 can range from about 1 millimeter to about 10 millimeters.

The inner and outer curves of the curved wall can be parallel to each other, as shown in this Figure. Extending from the uppermost portion of the curved wall outer side 21 is an extending lip 24 which can extend the entire length of the slat body. The extending lip 24 can extend from about 1 millimeter to about 10 millimeters from the outer side.

The top hook portion 10 can have a top hook 28 extending from the curved wall that curves around like a crooked index finger to a hook end 30 forming a second cavity 32. The second cavity 32 can be generally opposite the central cavity 23. The diameter of the second cavity 32 can range from about 3 millimeters to about 10 millimeters.

Opposite the curved wall 22 is the ledge section 14 that can have a first curved inner wall 17 which can be connected to and extends opposite the inner wall 25 forming the central cavity 23.

Opposite the hook end 30 in the ledge section 14 is the ledge 18. An opening 34 is formed between the hook end 30 and the ledge 18 which can range from about 3 millimeters to about 10 millimeters.

Extending into a space dividing the central cavity 23 and the second cavity 32 is a reinforced section 26. The reinforced section 26 can be opposite the extending lip 24 at the top portion of the inner side 25.

The top hook portion 10 can look very similar in profile to a right hand in profile, with a thumb as the ledge section and the curved over digits as the top hook and the knuckle as the extending lip and the pad part of the palm as the reinforced section.

FIG. 3 is a detailed view of a bottom hook portion.

The bottom hook portion is shown with a counter wall 40, which can extend from the slate body 2 with a slight curve, and a bottom hook 42, which can extend away from the slate body opposite the counter wall 40 forming a bottom cavity 44. The bottom cavity 44 can have a diameter from about 3 millimeters to about 20 millimeters.

The bottom hook 42 can have a bottom hook end 43, which can be opposite the second end 38 that can extend back towards the slat body 2 in the manner of a crooked finger. A bottom opening 46 is formed between the bottom hook end 43 and a counter wall end 41.

FIG. 3 also shows an insulating coating 54, which can be disposed on the bottom receptacle portion 36, which can stop static electricity buildup, and help to prevent an electrical path in the case of lightning strikes.

FIG. 4 shows a bottom receptacle portion 36 having within it, the top hook portion 10. Additionally, this embodiment shows an alignment device 50 which prevents slat movement in a plane perpendicular to the rails. The alignment device 50 can be positioned in the central cavity and held in place with a fastener 48.

In other embodiments, the alignment device can be a threaded device, or a pop rivet and the alignment device head can have a diameter larger than an outer diameter of the bottom receptacle portion.

In embodiments, the alignment device can be a screw, a bolt, a pop rivet, a rod or combinations thereof. In an additional embodiment, the alignment device can be a retaining alignment lock. The retaining alignment lock can be used to additionally secure the shutter slats within the guide rails.

The alignment device can be disposed in the central cavity and can be secured into the central cavity with a fastener provided the alignment device is a hollow revolved U-shape with two heads, where each head has a diameter larger than an outer diameter of the bottom receptacle portion.

The alignment device can have a length from about 0.5 centimeter to about 9 centimeters and a diameter from about 0.5 centimeter to about 2 centimeters. The alignment device can further be hollow or solid.

Figure 5:
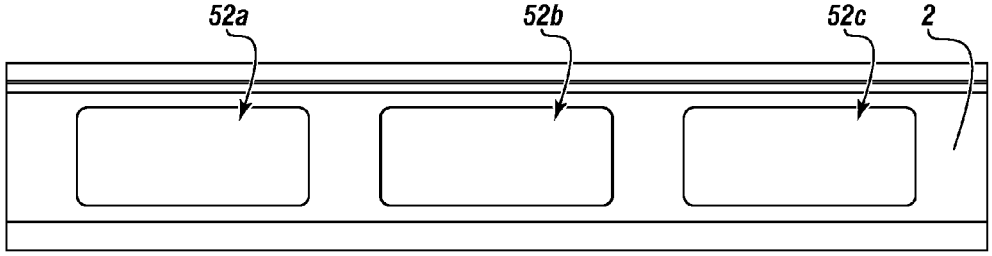
FIG. 5 is a detailed view of a perforation configuration for a slat body.

FIG. 5 shows an embodiment of the invention wherein perforations 52*a*, 52*b*, and 52*c* are in the slat body 2.

The plurality of perforations 52*a*, 52*b*, and 52*c* can be disposed through each slat body 2 and can all have the same shape, such as a triangle, square, rectangular, polygonal, another geometrical shape, or combinations thereof.

In embodiments, some perforations can be larger than others for ease of viewing out of a window in a section protected by the rolling shutter assembly.

The density of the perforations can run from about 100 per square meter to about 10000 per square meter per slat body.

The plurality of perforations can each have an opening arranging from about 0.3 centimeters to about 10 centimeters.

In an embodiment, the plurality of perforations is formed to ensure that at least 50 percent of the slat material remains in the slat.

Figure 6:
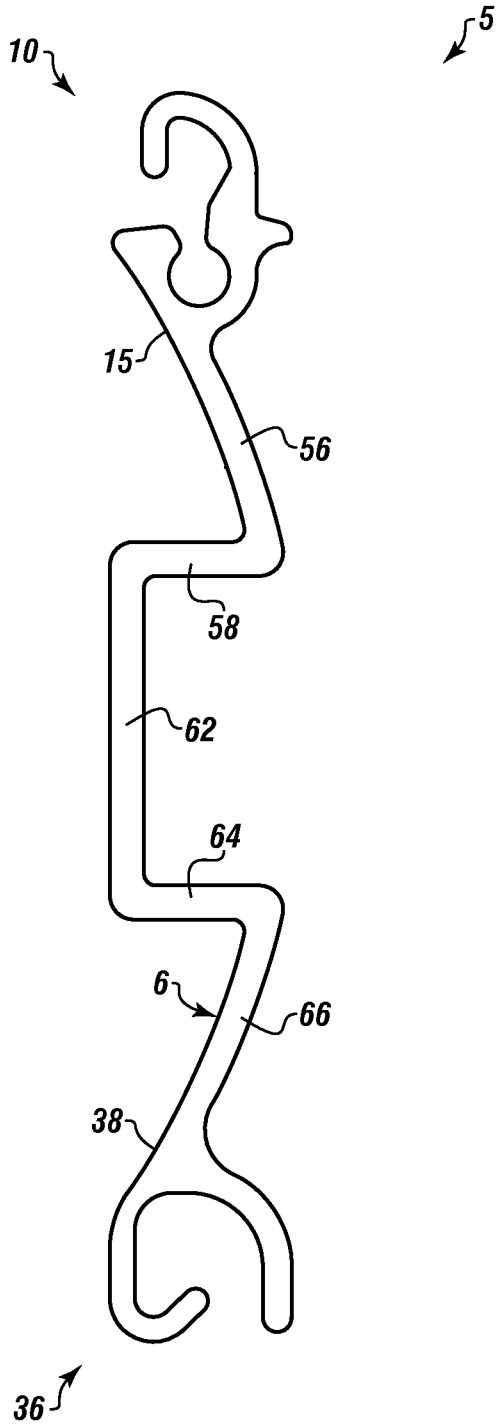
FIG. 6 is another embodiment of a slat body.

FIG. 6 shows another embodiment of the single wall shutter slat 5 for the rolling shutter assembly having the first end 15 and the second end 38. The embodiment further shows the top hook portion 10, the curved back side 6, and the bottom receptacle portion 36.

Connected to the first end 15 is a first segment 56. A second segment 58 is connected to the first segment 56 at an angle from about 30 degrees to about 60 degrees.

A third segment 62 can connect to the second segment 58 and at an angle from about 80 degrees to about 100 degrees.

A fourth segment 64 can connect to the third segment 62 at an angle from about 80 degrees to about 100 degrees.

A fifth segment 66 can connect to the fourth segment 64 at an angle from about 30 degrees to about 60 degrees. The fifth segment 66 can engage the second end 38. The first end and the second end can each have the same configurations as the embodiment described in FIG. 1.

Figure 7:
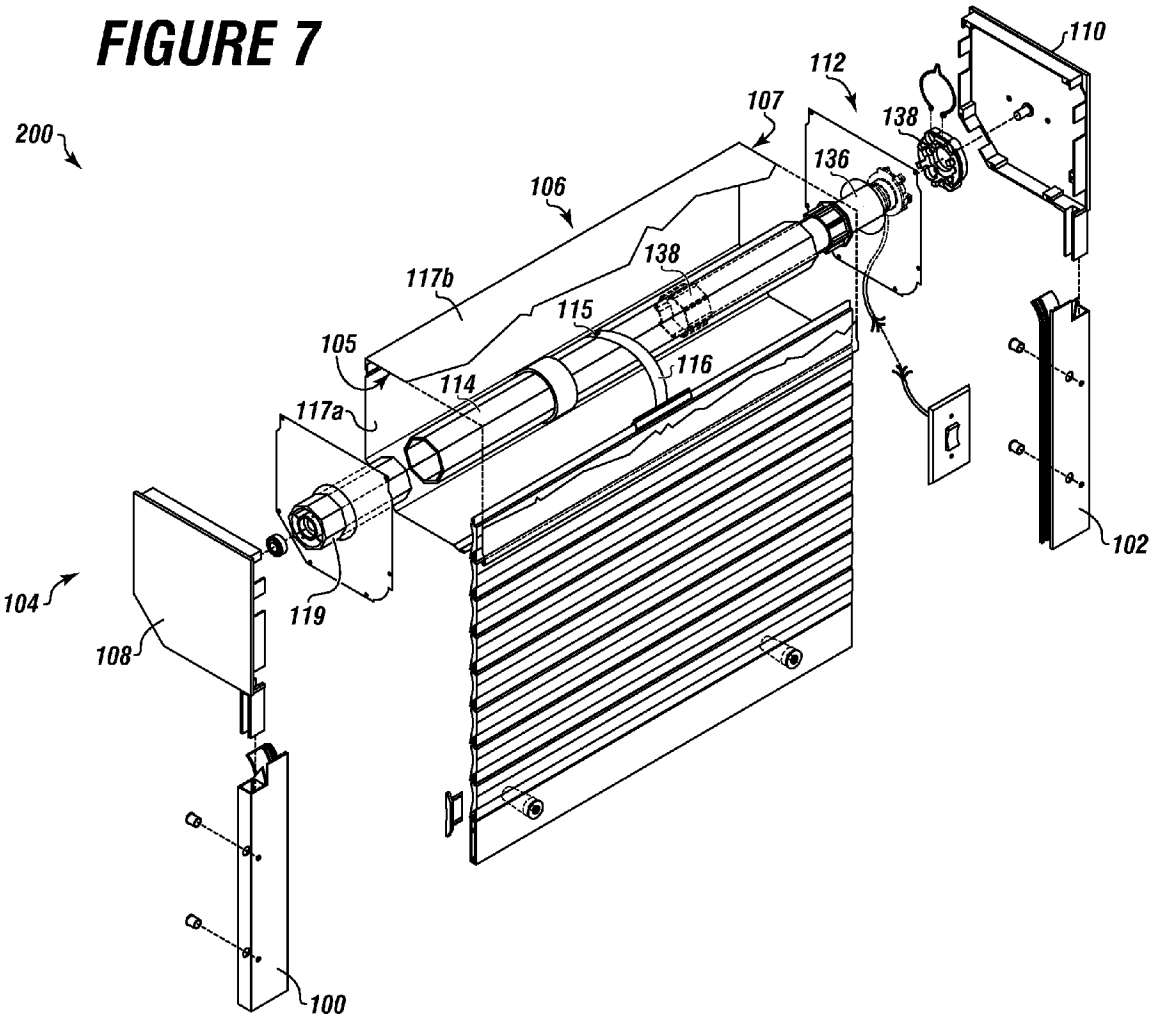
FIG. 7 is an exploded view of the rolling shutter housing.

FIG. 7 is an exploded view of the rolling shutter assembly 200 with rails 100 and 102.

The rolling shutter assembly 200 can cover an opening of the facility, which can be a door, a window, or a frangible item.

The rolling shutter assembly 200 can have a first shutter rail 100 mounted to the facility such as with threaded screws or rivets for use with wood, or concrete.

A second shutter rail 102 can be mounted to the facility in parallel with the first shutter rail 100 and spaced apart from the first shutter rail. The rails can be spaced to cover any user specified opening, such as a 2 foot×3 foot window, a door, or to cover artwork in a recess.

A rolling shutter housing 104 is shown to entail a rolling shutter cover 106 with a first end 105 and a second end 107 opposite the first end 105.

The rolling shutter cover 106 can be formed from two components, a front cover component 117*a* and a back cover component 117*b*.

The rolling shutter housing 104 can contain a first side cap 108 mounted on the first end 105 of the rolling shutter cover and a second side cap 110 mounted on the second end 107 of the rolling shutter cover.

As used herein the term "rolling shutter cover" can refer to a protective cover that spans around the rotating axle while allowing enough space to house a plurality of rolled up single wall shutter slats a small opening to allow the single wall shutter slats to enter the rolling shutter cover.

The rolling shutter cover can be made from wood, aluminum, or another material that is durable and able to withstand, wind, water and severe weather. In some cases this rolling shutter cover can be made out of one piece or several pieces attached or hinged together.

As used herein the term "side cap" can refers to side and/or end pieces that attach to the rolling shutter cover and rails and which hold the driving mechanism and/or idler within the rolling shutter cover.

As used herein the term "mounted" can refer to fixing by use of screws or other fasteners.

A drive mechanism 112 can be attached to the first side cap 110 and a rotating axle 114 contained in the rolling shutter cover 106 can be attached to the drive mechanism for rotating.

The rotating axle can be a tube, with a diameter from about 2 inches to about 10 inches, and a length from about 24 inches to about 360 inches. The motor can insert into the axle and rotate the axle.

The rotating axle can be made from aluminum, steel, plastic, a composite or combinations thereof. The rotating axle can be a tubular member capable of housing a motor.

The drive mechanism 112 can include a motor 136 connected to a gear system 138 to rotate the rotating axle. The motor is connected to a generator (not shown). However, in embodiments the drive mechanism can be, a member of the group: a motor 136 connected to the rotating axle 114, a gear system 138 connected to the rotating axle, or a motor 136 connected to a gear system 138 connected to the rotating axle. An idler 119 can be attached to the axle.

The rotating axle 114 can have a connecting mechanism 116 for positioning the first shutter slat away from the rotating axle and a connector 115 that holds the connecting mechanism 116 to the rotating axle 114.

Figure 8:
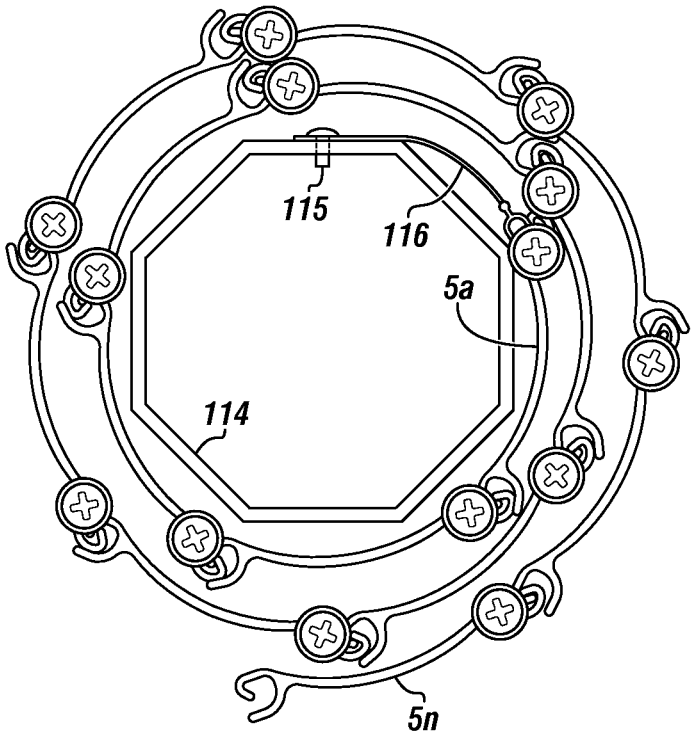
FIG. 8 is a view of the plurality of single wall shutter slats in a rolled position.

FIG. 8 is an end view of the plurality of single wall shutter slats in a rolled up configuration.

The plurality of single wall shutter slats 5*a*-5*n* adapted to be generally contained within the rolling shutter housing.

The first single wall shutter slat 5*a* is shown connected to the rotating axle 114 with the connecting mechanism 116 for positioning the first shutter slat away from the rotating axle and the connector 115 holds the connecting mechanism to the rotating axle. The connecting mechanism 116 can be a cantilever spring.

Figure 11:
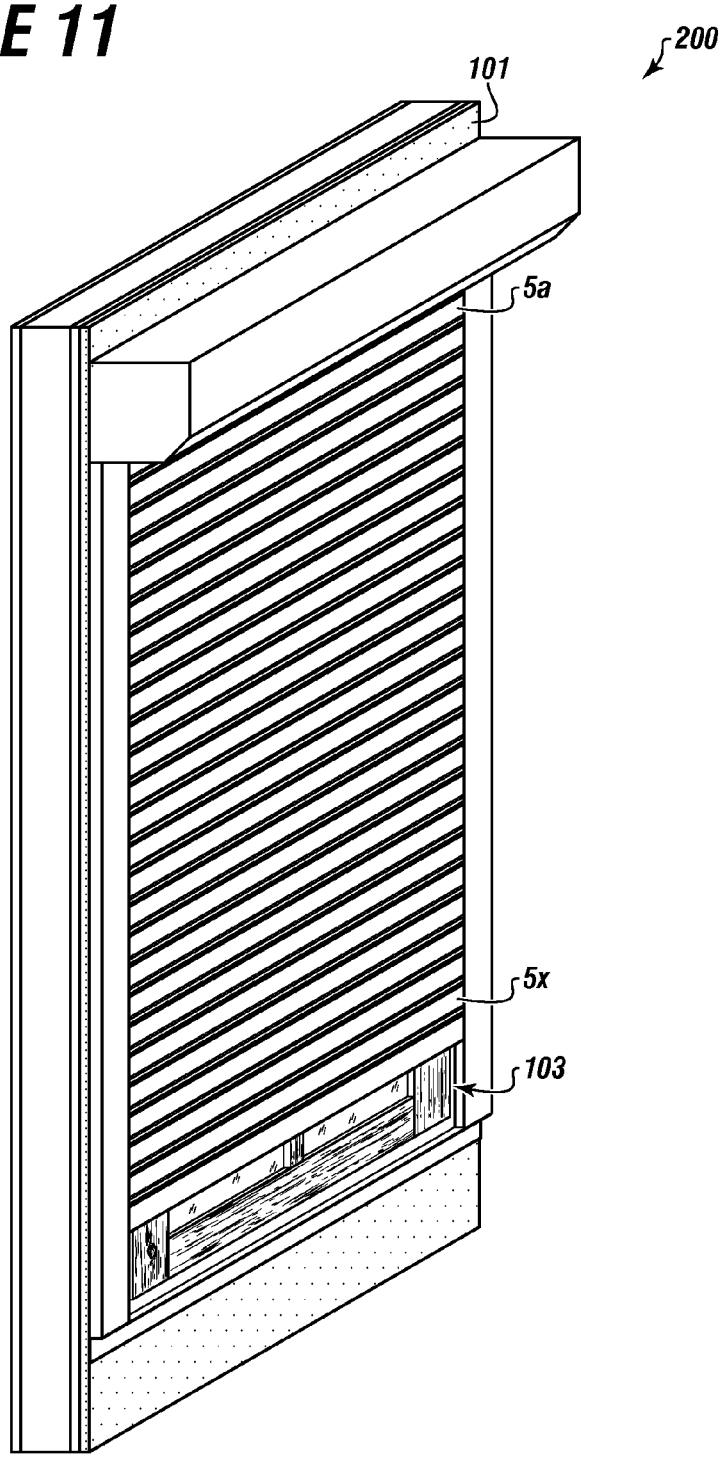
FIG. 11 is a deployed rolling shutter assembly forming a protection wall mounted to a facility.

The plurality of single wall shutter slats can be connected in series and are moved from the rolling shutter housing for use from the rolled up orientation shown in FIG. 8 to a curtain orientation shown in FIG. 11. The curtain orientation is sometimes referred as a protection wall, over an opening or other item. The opening can be a window, or a door.

Figure 9A:
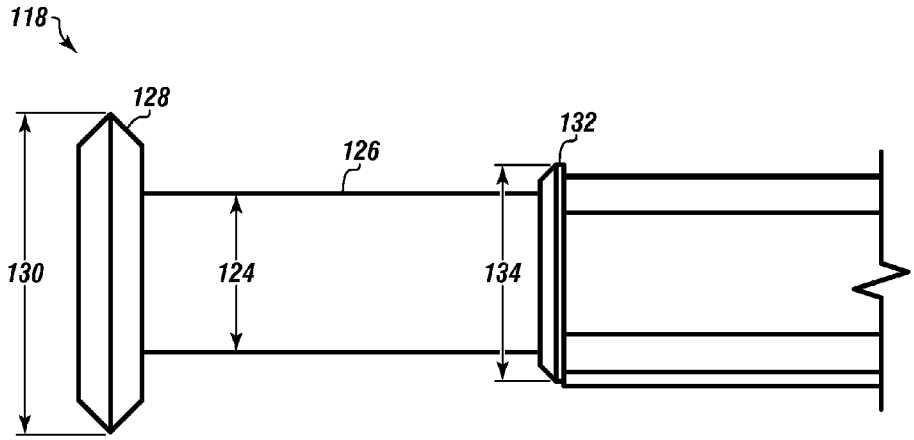
FIGS. 9A and 9B are views of an end retention device usable with the rolling shutter assembly.
Figure 9B:
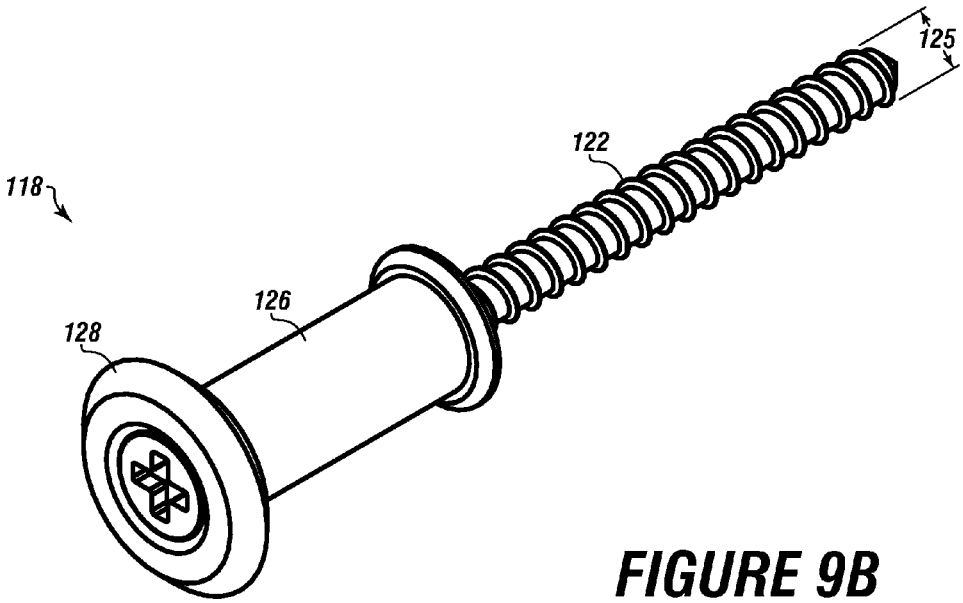

The single wall shutter slats are deployed from the rolled-up orientation, using the drive mechanism forming a gap-less protection wall over the opening or another object needing projection, and then rolled back up from the wall/curtain orientation to the rolled up orientation into the rolling shutter cover for storage FIGS. 9A and 9B are view of an end retention device 118 according to embodiments usable with the rolling shutter system.

Pairs of end retention devices can be used to connect single wall shutter slats to the rails. The end retention devices engage the rails as the single wall shutter slats are deployed from a rolled up orientation to a wall/curtain orientation.

The end retention devices have the remarkable benefit of preventing the slats from pulling out of the rails and to engage with fins contained in the rails to prevent the slats from pulling away from the rails.

The end retention device is expected to cause the curtain/wall to withstand high impacts, such as at 38 feet per second for a 20×10 foot opening.

Other embodiments of the end retention device are also usable with square heads, or oval heads.

The end retention device 118 can have a threaded shaft portion 122 having a threaded shaft outer diameter 125. The threaded shaft outer diameter can be from about 0.2 cm to about 3 cm.

The end retention device 118 can have a smooth shaft portion 126 having a smooth shaft outer diameter 124. The smooth shaft portion can be from about 0.2 cm to about 3 cm.

The end retention device 118 can have a beveled head 128 with a beveled head outer diameter 130.

The beveled head outer diameter 130 can be larger than the smooth shaft outer diameter 124, such as 10 percent to 200 percent larger. The beveled head outer diameter can range from about 0.5 cm to about 6 cm, in embodiment.

The end retention device 118 can have a flange portion 132 with a flange outer diameter 134. The flange outer diameter can range from 0.3 to 4 cm.

The flange outer diameter can be smaller than the beveled head outer diameter but larger than the smooth shaft outer diameter. The flange outer diameter can range from 10 percent to 200 percent larger than the smooth shaft outer diameter.

Figure 10:
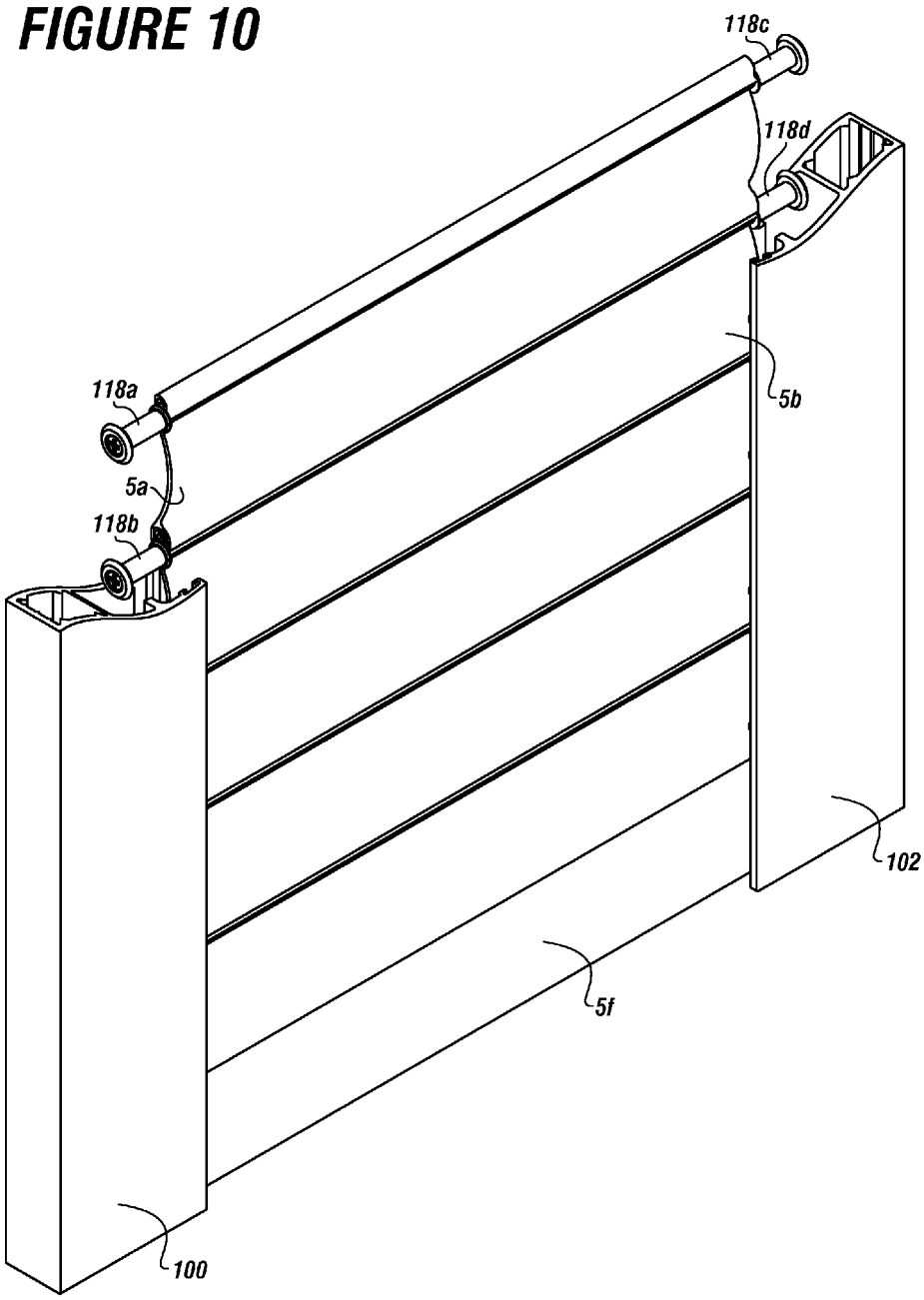
FIG. 10 is an isometric view of end retention devices installed in the rolling shutter system to the invention.

FIG. 10 is an isometric view of four different end retention devices installed in the rolling shutter system to the invention.

A pair of end retention devices 118*a* and 118*c* are installed on a single wall shutter slat 5*a*.

Another pair of end retention devices 118*b* and 118*d* are installed to connect the first single wall shutter slat 5*a* to a second single wall shutter slat 5*b* and to engage the first shutter rail 100 and the second shutter rail 102.

Additional single wall shutter slats 5*f* can be used according to the invention engaging the first shutter rail 100 and second shutter rail 102.

FIG. 11 is a deployed rolling shutter assembly 200 forming a protection/curtain wall and showing the opening 103 over which the curtain is deployed.

The protection curtain is created from single wall shutter slats 5*a* to 5*x*, each slat sitting on a lip and ledge of an adjacent single wall shutter slat.

The facility 101 to which the rolling shutter assembly 200 is mounted is shown.

Figure 12:
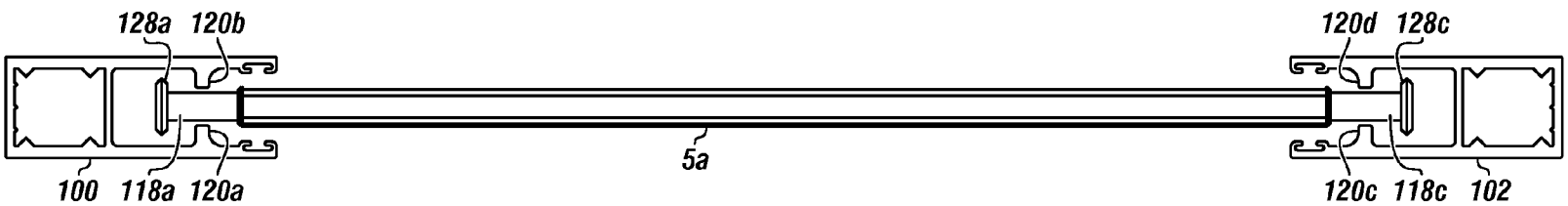
FIG. 12 provides a detail of the end retention device and the fins usable therein.

FIG. 12 provides a top view of a single wall shutter slat 5*a* engaging with the first shutter rail 100 and the second shutter rail 102.

A pair of fins 120*a* and 120*b* project from first shutter rail and another pair of fins 120*c* and 120*d* project from the second shutter rail.

Each shutter rail has a pair of fins 120*a* and 120*b* project from the first shutter rail.

The bevel heads of the pair of end retention devices 118*a* and 118*c* are contained by the fins. The first beveled head

128*a* is contained by fins 120*a* and 120*b* and the second beveled head 128*c* is contained by fins 120*c* and 120*d*.

The beveled heads slidable engage the channels defined by each pair of fins.

While these embodiments have been described with emphasis on the embodiments, it should be understood that within the scope of the appended claims, the embodiments might be practiced other than as specifically described herein.

What is claimed is:

1. A rolling shutter assembly for covering an opening of a facility, wherein the rolling shutter assembly comprises:

a. a first shutter rail;

b. a second shutter rail;

c. a rolling shutter housing to connect with ends of the first shutter rail and the second shutter rail, the rolling shutter housing comprising:

(i) a rolling shutter cover with a first end and a second end opposite the first end;

(ii) a first side cap mounted on the first end of the rolling shutter cover;

(iii) a second side cap mounted on the second end of the rolling shutter cover;

(iv) a drive mechanism attached to one of the rolling shutter housing side caps and an idler attached to the other rolling shutter cover side cap opposite the drive mechanism; and (v) a rotating axle contained in the rolling shutter cover and attached between the driving mechanism and the idler; and d. a plurality of interlocking and pivotally interconnecting curved single wall shutter slats adapted to be contained within the rolling shutter cover, wherein a first single wall shutter slat is connected to the rotating axle with a connecting mechanism for positioning the first single wall shutter slat away from the rotating axle, and wherein additional single wall shutter slats are connected in series to the first single wall shutter slat, and each single wall shutter slat comprises an integral structure having:

(i) a slat body with a curved front side and a curved back side;

(ii) a top hook portion on a first end of the curved back side, the top hook portion comprising:

1. a ledge section with a ledge;

2. a top hook with a hook end forming a second cavity; and 3. a hook section comprising:

i. a curved wall forming a central cavity;

ii. an extending lip extending from the curved wall on an outer side;

iii. a reinforced section between the curved wall and the top hook, wherein the top hook comprises a hook end extending towards the ledge section with the second cavity generally opposite the central cavity; and iv. an opening formed between the hook end and the ledge;

(iii) a bottom receptacle portion for holding the top hook portion of an adjacent single wall shutter slat, wherein the bottom receptacle portion comprises a counter wall with a counter wall end opposite a bottom hook with a bottom hook end forming a bottom cavity with a bottom opening between the counter wall and the bottom hook;

(iv) the top hook portion is adapted to slide into the bottom receptacle portion of the adjacent single wall shutter slat to pivotally engage between the bottom hook and the counter wall allowing the counter wall end to contact and transfer load to the extending lip and the bottom hook to contact and transfer load to the ledge; and (v) an alignment device disposed proximate or over the central cavity for aligning the first single wall shutter slat with the additional single wall shutter slats in the central cavity; and wherein the single wall shutter slats connect in series for first moving from a rolled up orientation to a curtain orientation over the opening using the drive mechanism forming a gap-less protection wall over the opening, and then second moving from the curtain orientation to the rolled up orientation within the rolling shutter cover.

2. The rolling shutter assembly of claim 1, comprising a plurality of end retention devices, wherein each end retention device has a portion insertable into the central cavity of the single wall shutter slat and a portion insertable into one of the first and second shutter rails.

3. The rolling shutter assembly of claim 1, wherein the rolling shutter cover comprises a front cover component that interlocks with a back cover component.

4. The rolling shutter assembly of claim 2, comprising a pair of fins to contain the portion of the end retention device insertable in the first and second shutter rails.

5. The rolling shutter assembly of claim 2, wherein the end retention device further comprises:

a. a threaded shaft portion having a threaded shaft outer diameter;

b. a smooth shaft portion having a smooth shaft outer diameter;

c. a beveled head with a beveled head outer diameter, wherein the beveled head outer diameter is larger than the smooth shaft outer diameter; and d. a flange portion with a flange outer diameter, wherein the flange outer diameter is smaller than the beveled head outer diameter but larger than the shaft outer diameter.

6. The rolling shutter assembly of claim 1, wherein the alignment device further comprises a fastener portion connected to a fastener head.

7. The rolling shutter assembly of claim 1, wherein the alignment device is a threaded device.

8. The rolling shutter assembly of claim 6, wherein the alignment device is a pop rivet and the fastener head has a diameter larger than an outer diameter of the bottom receptacle portion.

9. The rolling shutter assembly of claim 1, wherein the alignment device is secured into the central cavity with a fastener and the fastener has a diameter larger than an outer diameter of the bottom receptacle portion.

10. The rolling shutter assembly of claim 1, wherein the central cavity is out of alignment with the second cavity.

11. The rolling shutter assembly of claim 1, further comprising a plurality of perforations disposed through the slat body having a shape selected from a member of the group: a triangle, a square, a rectangle, a polygon, and combinations thereof.

12. The rolling shutter assembly of claim 11, wherein the plurality of perforations can each have an opening from 0.3 centimeters to 10 centimeters.

13. The rolling shutter assembly of claim 11, wherein the plurality of perforations are formed to ensure that 50 percent of the slat material remains in the single wall shutter slat.

14. The rolling shutter assembly of claim 1, wherein the single wall shutter slats each have an overall length from 24 centimeters to 8 meters and the overall height from 40 millimeters to 120 millimeters.

15. The rolling shutter assembly of claim 1, wherein the thickness of each slat body is from 1 millimeter to 10 millimeters.

16. The rolling shutter assembly of claim 1, wherein the single wall shutter slat comprises: aluminum, steel, a metal alloy, a polymer composite, a polymer, or combinations thereof.

17. The rolling shutter assembly of claim 1, comprising a cantilever spring as the connecting mechanism.

18. The rolling shutter assembly of claim 1, comprising a member of the group: a motor connected to the rotating axle, a gear system connected to the rotating axle, or a motor connected to a gear system connected to the rotating axle.

19. The rolling shutter assembly of claim 1, wherein the rotating axle is a tubular member capable of housing a motor.

* * * * *